US005261469A

United States Patent [19]

Severson

[11] Patent Number: 5,261,469

[45] Date of Patent: Nov. 16, 1993

[54] APPARATUS FOR FORMING CURLED WOOD SHAVINGS

[76] Inventor: Harvey M. Severson, 8418 Dupont Ave. S., Minneapolis, Minn. 55420

[21] Appl. No.: 976,492

[22] Filed: Nov. 13, 1992

[51] Int. Cl.[5] ..... B02C 18/18; B02C 7/12; B27C 1/00

[52] U.S. Cl. ..... 144/176; 144/162 R; 144/218; 241/92; 241/296; 241/298

[58] Field of Search ..... 241/92, 296, 298; 144/162 R, 172, 174, 176, 373, 218

[56] References Cited

U.S. PATENT DOCUMENTS 3,286,745 11/1966 Meis ..... 144/178

5,097,879 3/1992 Rice, Sr. ..... 144/176

5,139,063 8/1992 Nettles et al. ..... 144/176

*Primary Examiner*—W. Donald Bray

*Attorney, Agent, or Firm*—Merchant, Gould, Smith, Edell, Welter & Schmidt

[57] ABSTRACT

A wood curl-making apparatus includes a rotating disc having cutting blades mounted so as to extend from the face of the disc to engage wood pieces fed to the disc. The blades are mounted in cutting blocks attached to the disc. The cutting blocks have curved curling surfaces which receive the wood shaving and force the shaving to curl. When the shavings have been removed, they fall in a tightly curled roll.

19 Claims, 3 Drawing Sheets

APPARATUS FOR FORMING CURLED WOOD SHAVINGS

BACKGROUND OF THE INVENTION

1. Field of the Invention

The present invention is directed to an apparatus and method for forming curled wood shavings.

2. Description of the Prior Art

Curled wood shavings are used for a variety of purposes, including use as a packing material, use in potpourris, and use in arts and crafts for kindling to start fires. Use of curled wood shavings has thus far been limited, as producing quality shavings with a tight curl, spiraling so that the curl wraps tightly around itself repeatedly, has been difficult and expensive.

Although standard wood planes do produce wood curls, the curls which are produced have radiuses of curvature which vary greatly. Also, the width and length of the curls may vary greatly. In addition to finding a method for producing nearly identical wood curls, the speed with which the curls are produced must be fast enough so that cost can be reduced. Present planing processes are quite slow. In addition, it can be very difficult to vary the size and/or length of the curls in a consistent manner with a single apparatus.

It can be seen then, that a new and novel method and apparatus for producing a consistent size and grade of wood curls is needed. In particular, it can be seen that an apparatus and method is needed which produces wood curls at high volume and at a very low cost. It can be further seen that an apparatus and method is needed which can be utilized to produce wood curls of varied size, length, and curl radius from a single apparatus.

SUMMARY OF THE INVENTION

The present invention is directed to an apparatus for making curled wood shavings. The present invention includes a rotating disc having one or more blades extending from a face thereof. The blades are mounted in cutting blocks mounting to the disc. The cutting blocks include curling surfaces proximate the cutting blades. The curling surface has a curved surface extending parallel to the cutting blade.

Wood pieces are fed to the face of the disc. As the disc rotates, the blades engage the leading edge of the wood. The blades remove shavings from the wood pieces. The shavings are forced into the curling surface as the shavings are being removed from the wood. As the shaving engages the curved surface, the shaving is forced to curl. As a greater length of shaving is removed from the wood, the shaving is forced to curl around itself. When the shaving has been removed from the wood, it falls in a tightly curled roll.

The cutting block is configured so that the blade may be adjusted for deeper or shallower cuts. The type of blade may be changed to create other types of cuts as well. In one embodiment, the cutting block includes curling surface inserts which provides for interchanging inserts having different radii of curvature for making larger or tighter curls. The apparatus also includes a row of retractable screws located before the cutting blades which may be used to score the wood prior to cutting so that a number of narrow curls are produced.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
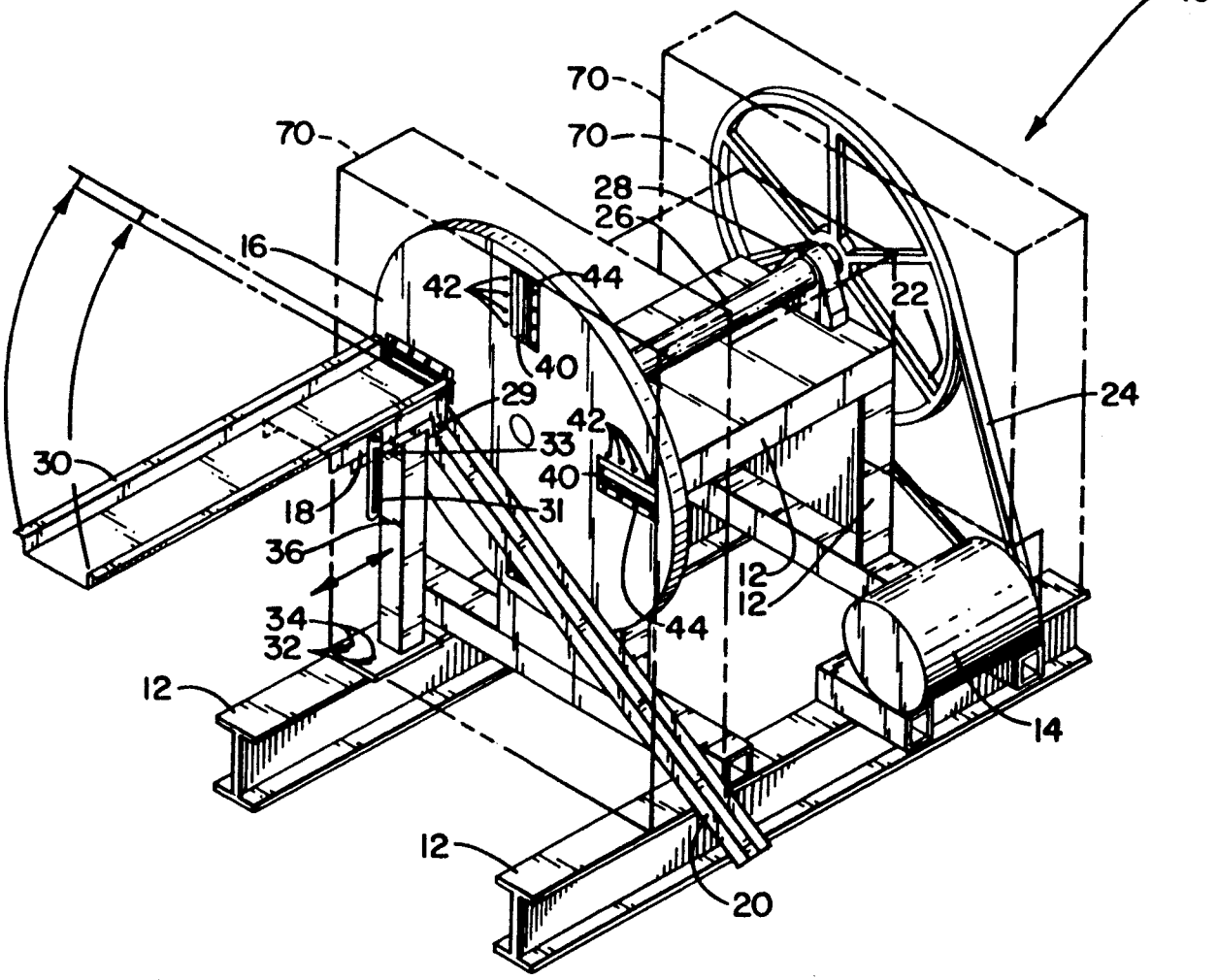
FIG. 1 shows a perspective view of a curled wood shaving making apparatus according to the principles of the present invention.

Referring now to the drawings, wherein like reference numerals designate corresponding structure throughout the views, and referring in particular to FIG. 1, there is shown a wood curl-making apparatus, generally designated 10. The curled wood shaving apparatus 10 includes a frame 12 supporting a motor 14. The motor 14 drives a belt 24 rotating a pulley 22. The pulley 22 is mounted on a shaft 26 which is connected to a flywheel disc 16. Therefore as the motor 14 is activated, the disc 16 rotates. The apparatus 10 also includes shrouds 70 to cover moving parts for added safety.

Mounted on the frame 12 proximate a face of the disc 16 is a wood piece supporting ledge 18 which supports a wood feeder portion 30 mounted to the ledge 18. The feeder portion 30 pivots about hinge 29. The feeder portion 30 includes slotted guide 31 which is used to control the angle with adjustment bolt 33. The ledge 18 has a support post 36 which is adjustably slidably mounted by legs 32 in slots 34 on the frame 12.

Figure 2:
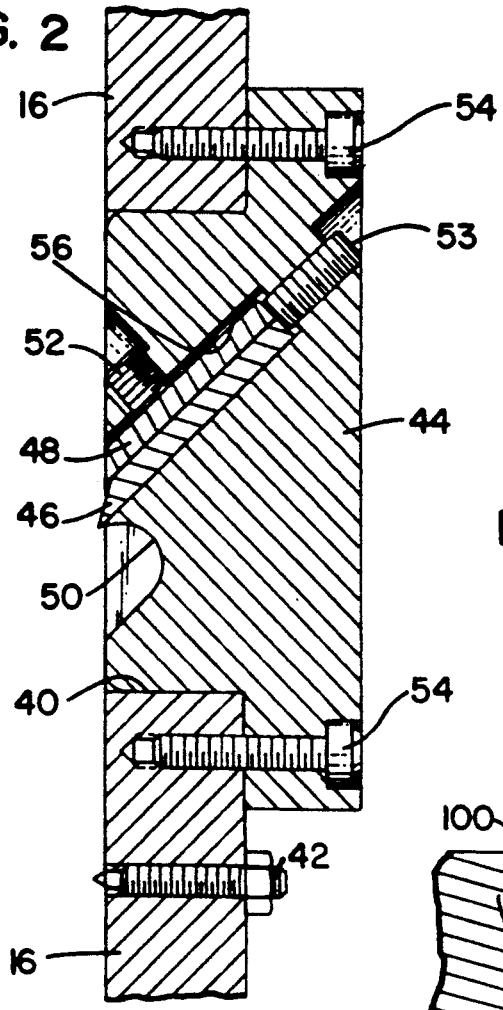
FIG. 2 shows a side sectional view of a cutting block mounted on the disc of the curled wood shaving making apparatus.
Figure 5:
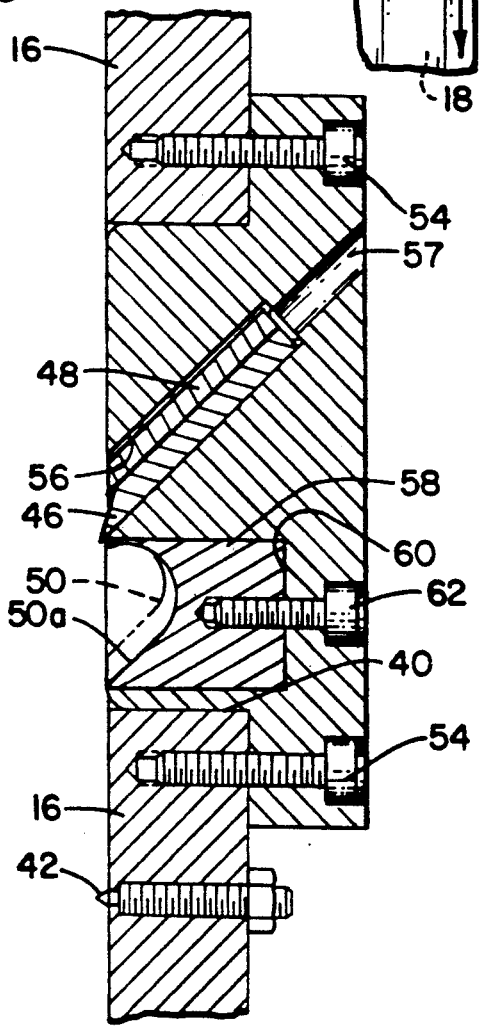

On the flywheel disc 16, a plurality of orifices 40 are formed near its periphery. The orifices 40 retain cutting blocks 44. Proximate and before the orifices 40, in the same radius, are a plurality of scoring screws 42, as also shown in FIG. 2. The scoring screws 42 are utilized to score blocks of wood to provide a narrower width of curled wood shavings, as explained hereinafter. As shown in FIG. 2, the cutting blocks 44 are mounted by bolts 54 to the flywheel disc 16 on a second face thereof. The cutting block 44 includes a blade 46 which can be retained in a slot 56 with a shim 48 and retaining screws 52. The cutting depth can be changed by rotating adjustment screws 53. As shown in FIG. 5, the block 44 has an access aperture 57 formed therein to access the shim 48 and the blade 46. A punch may be inserted into the aperture 57 to loosen the shim 48 and the blade 46. In this manner, the blade 46 may be easily removed and replaced or may be adjusted to project further in or out to affect the cutting operation, as explained hereinafter. In addition, serrated or other edges on the blade 46 may be utilized to produce a decorative or other type of curled wood shaving.

Figure 3:
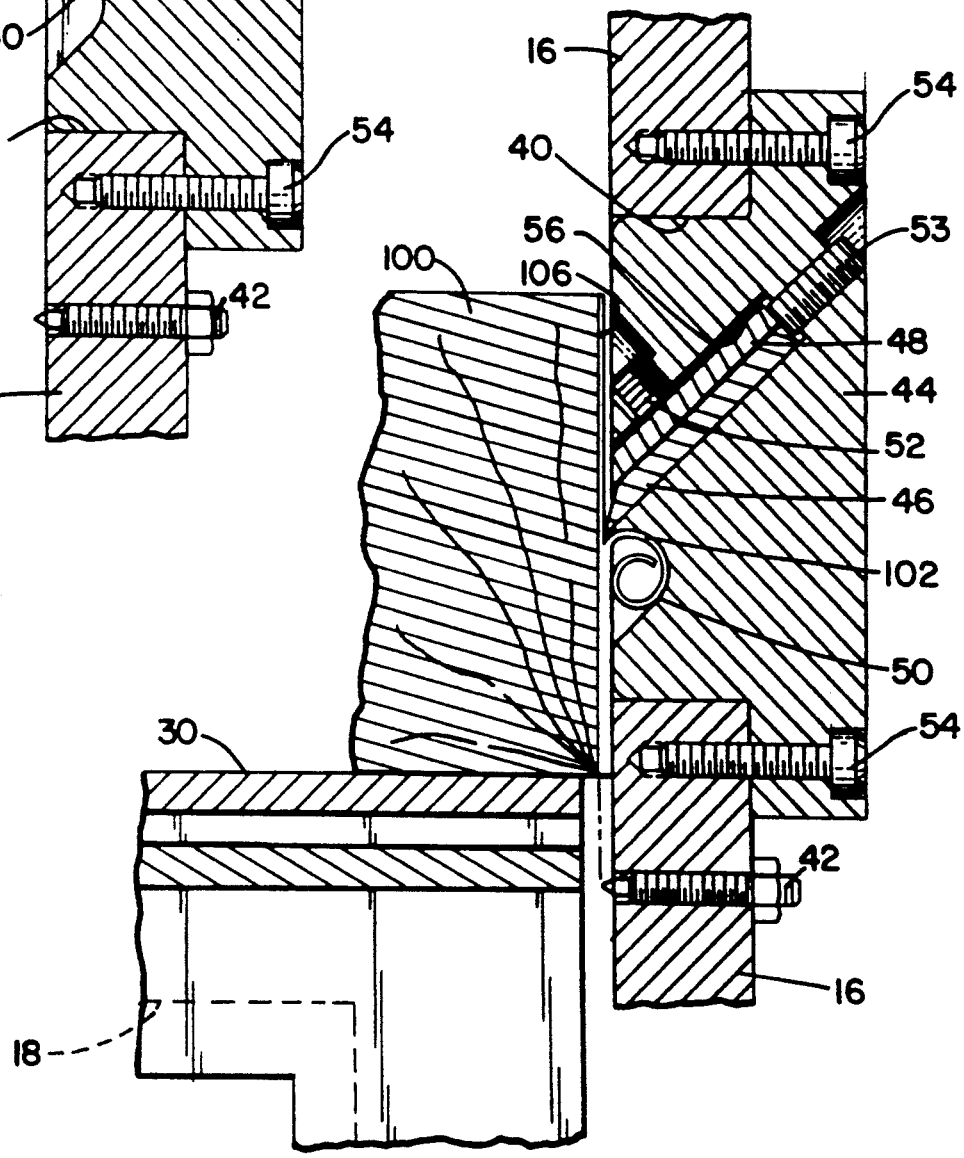
FIG. 3 shows a side sectional view of the cutting block shown in FIG. 2 midway through a cut.
Figure 4:
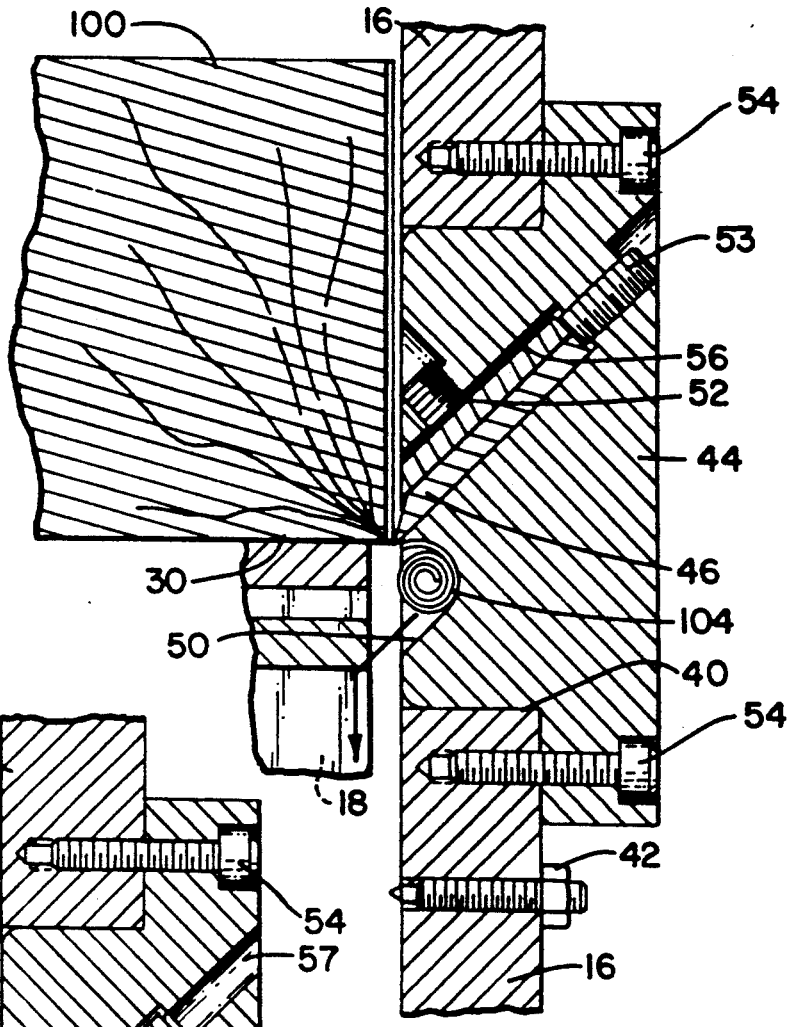
FIG. 4 shows a side sectional view of the cutting block shown in FIG. 2 at the end of a cut; and, FIG. 5 shows a side sectional view of a second embodiment of a cutting block.

As shown in FIGS. 2–4, the cutting block 44 includes a curved curling surface 50 extending parallel to the blade 46. As explained hereinafter, wood shavings 102 are cut from the wood blocks 100 fed to the apparatus 10 and wood shavings 102 are forced to the curving surface 50 to form curls 104.

As shown in FIG. 5, according to a second embodiment of the present invention, the cutting block 44 includes a wood curling insert 58. The insert 58 mounts in an insert slot 60 and is held in place by retaining screws 62. In this manner, curling inserts 58 can be interchanged with other inserts having a different radius of curvature 50*a* to form tighter or larger curls, depending on the wood curl desired.

In operation, wood pieces 100 are fed to the apparatus 10 along the removable ledge portion 30 on the ledge 18. The wood pieces 100 are forced against the face of the flywheel disc 16 which is rotatably driven by the motor 14. As a plurality of cutting blocks 44 are mounted in the orifices 40 in the disc 16, a plurality of blades 46 extend beyond the face of the disc through the orifices to engage the wood pieces 100. It can be appreciated that if narrower curls are desired than the width of the wood piece 100, the scoring screws 42 are adjusted to protrude beyond the face of the disc 16. The scoring screws 42 then score the wood block 100 to form grooves 106 in the face of the wood which are deeper than the depth of the cut. When the blade cuts a shaving 102, the shaving is divided into a plurality of narrower shavings forming a plurality of narrower curls 104 with a width equal to the distance between the scoring screws 42. It can also be appreciated that if a curl 104 is desired which has a width equal to the width of the wood piece 100, the scoring screws 42 are retracted so that they do not protrude beyond the face of the disc 16 and do not engage the wood pieces 100.

As shown in FIG. 3, as the blade 46 engages the wood piece 100, a narrow shaving 102 is removed from the face of the wood piece 100. The blade 46 can be adjusted for deeper or shallower cuts, commonly in the range between 10 and 20 thousandths and typically 12 thousandths. As the disc 16 continues to rotate past the wood piece 100, the wood shaving 102 is forced before the blade 46 and by the ledge 18 into the curved curling surface 50 of the cutting block 44. As the shaving 102 is forced into the curling surface 50, the shaving curls around itself to form a wood curl 104. When the blade 46 has passed entirely through the wood piece 100, as shown in FIG. 4, the shaving 102 falls from the wood piece 100 and has taken on a tightly curled configuration. The curls 104 fall onto the trough or conveyor 20 shown in FIG. 1, which is angled to direct the curls down for further processing, such as removal of unwanted chips and other irregularities.

It can be appreciated that by moving the ledge 18 closer to the face of the disc 16, the tightness of the curl 104 will be affected as a greater distance gives additional space for the curls 104 and increases the diameter of the curl, while a closer distance forms a tighter curl. It can also be appreciated that by having a deeper or narrow cut by the blade 46, the curling which occurs is affected by the thickness of the shaving 102. Further means of adjusting the tightness of the curl is accomplished by using a curved curling surface 50 having larger and smaller radiuses of curvature. It can be seen that the smaller the radius of curvature of the surface 50, the tighter the curl which is formed.

It can be appreciated that as the disc may spin at speeds of up to 500 rpm or greater, a disc having four cutting blades 46 would produce 2,000 curls per minute. It can be further appreciated that by having scoring screws which produce a plurality of narrower curls with each cut, the number of curls 104 produced is multiplied even more. Although only four orifices 40 and cutting blocks 44 are shown in the preferred embodiment, other numbers of orifices 40 and cutting blocks 44 may be utilized depending on the needs for the curls being produced.

It can be seen that the present invention provides for producing curled wood shavings 104 in a fast and efficient manner which produces consistent curls. It can also be appreciated that the apparatus is very efficient and can be operated at high speeds with very low maintenance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A wood curl-making apparatus for forming curled wood shaving from pieces of wood, comprising:

a) a rotating disc having a first face;

b) wood feeding means for delivering wood pieces to the face of the disc;

c) at least one removable cutting block mounted on the disc including a blade extending from the block to engage the wood pieces; and, d) curling surface means for receiving shavings from the wood pieces and curling the shavings; wherein the curling surface means comprises a concavity formed in the cutting block.

2. An apparatus according to claim 1, wherein the curling surface comprises a semicircular concave trough formed in the cutting block located below an associated blade.

3. An apparatus according to claim 1, wherein the cutting block attaches to the disc and includes a slot, and wherein the blade mounts in the slot.

4. An apparatus according to claim 3, wherein the cutting block includes a curling slot receiving a curling cartridge having a curved curling surface.

5. An apparatus according to claim 1, wherein the wood feeding means comprises a ledge extending to a position proximate the face of the disc, and wherein wood shavings engage the ledge and are directed into the curling slot.

6. A wood curl-making apparatus for forming curled wood shavings from pieces of wood, comprising:

a) wood delivery means for feeding wood pieces to a cutting location;

b) one or more cutting blades;

c) blade driving means for moving the blades across the wood pieces; and, d) curling surface means proximate each of the blades, wherein the curling surface comprises a continuous curved concavity extending parallel to the blade, wherein as the blade passes the wood pieces, shaving are directed from the blade into the concavity to form wood curls.

7. An apparatus according to claim 6 wherein the blades are angled relative to the wood pieces.

8. An apparatus according to claim 6, wherein the curling surface is located at an angle relative to a wood pieces.

9. A wood curl block for forming curled wood shavings, comprising a block body, wherein the block body includes a cutting face and a first slot and a second slot extending inward from the face, a first cartridge inserting into the first slot including a cutting blade, a second cartridge inserting into the second slot including a curl forming surface.

10. A wood curl block according to claim 9, wherein the slots are angled relative to the cutting face.

11. A wood curl block according to claim 9, wherein the slots are parallel.

12. A wood curl block according to claim 9, further comprising cartridge retaining means for holding the cartridges in the slots.

13. A wood curl block according to claim 9, wherein the second cartridge is removable and interchangeable with other cartridges having curl forming surfaces of different radiuses.

14. A wood curl block according to claim 9, wherein the first cartridge is removable and interchangeable with other cartridges having different blade surfaces.

15. A wood curl block according to claim 9, wherein the block includes a aperture leading to the blade slot for accessing the shim and blade.

16. A wood curl-making apparatus according to claim 6, further comprising scoring means for scoring the wood surface prior to cutting for creating a plurality of curls of narrower width.

17. A wood curl-making apparatus according to claim 6, wherein the wood delivery means is slidably mounted for adjusting the distance between the blades and the wood delivery means.

18. A wood curl-making apparatus according to claim 6, wherein the blades are adjustably mounted for varying the depth of the cut.

19. A wood curl-making apparatus according to claim 6, further comprising a trough for catching curls.

* * * * *